US005446229A

United States Patent [19]

Taylor et al.

[11] Patent Number: 5,446,229

[45] Date of Patent: Aug. 29, 1995

[54] THERMAL CRACKING PROCESS WITH REDUCED COKING

[75] Inventors: Don M. Taylor, League City; Lynn M. Allen, Navasota; Myron E. Schroeder, Tomball, all of Tex.

[73] Assignee: Amoco Corporation, Chicago, Ill.

[21] Appl. No.: 162,025

[22] PCT Filed: Dec. 9, 1993

[86] PCT No.: PCT/US93/11730

§ 371 Date: Dec. 9, 1993

§ 102(e) Date: Dec. 9, 1993

[87] PCT Pub. No.: WO94/14923

PCT Pub. Date: Jul. 7, 1994

Related U.S. Application Data

[63] Continuation-in-part of Ser. No. 992,719, Dec. 18, 1992, abandoned.

[51] Int. Cl.[6] ..... C07C 4/04

[52] U.S. Cl. ..... 585/648; 585/649; 585/650; 585/651; 585/652; 585/653; 208/52 CT; 208/132

[58] Field of Search ..... 585/648, 649, 650, 651, 585/652, 653; 208/52 CT, 132

[56] References Cited

U.S. PATENT DOCUMENTS

| | | | |
|---|---|---|---|
| 4,321,128 | 3/1982 | Yoo | 208/114 |
| 4,542,253 | 9/1985 | Kaplan et al. | 585/650 |
| 4,599,480 | 7/1986 | Buddell et al. | 585/650 |
| 5,000,836 | 3/1991 | Forester | 208/48 AA |
| 5,171,921 | 12/1992 | Gaffney et al. | 585/653 |
| 5,284,994 | 2/1994 | Brown et al. | 585/648 |

FOREIGN PATENT DOCUMENTS

| | | |
|---|---|---|
| 0158968 | 10/1985 | European Pat. Off. . |
| 2092626 | 6/1970 | France . |

*Primary Examiner*—Anthony McFarlane

*Attorney, Agent, or Firm*—Scott P. McDonald; Wallace L. Oliver

[57] ABSTRACT

A process for the production of olefins in an olefin plant, which includes an olefin pyrolysis furnace having pyrolysis tubes in which hydrocarbon feedstock is cracked, comprises introducing hydrocarbon feed substantially free of phosphorous-containing compounds into the pyrolysis furnace and operating the furnace under pyrolysis conditions producing olefin-containing effluent therefrom wherein the pyrolysis tubes have an effective passivator of metal catalytic sites bonded to the exposed metal surface by injecting an effective passivator into the furnace at a point above the dew point of water.

7 Claims, 2 Drawing Sheets

THERMAL CRACKING PROCESS WITH REDUCED COKING

CROSS-REFERENCE TO RELATED APPLICATIONS

This application is a continuation-in-part to U.S. Ser. No. 07/992,719 filed Dec. 18, 1992, now abandoned, which is incorporated herein by reference.

BACKGROUND OF THE INVENTION

This invention relates to a process for converting hydrocarbon feedstocks to olefins by thermal cracking in high temperature cracking or pyrolysis furnaces. In a particular aspect, the invention relates to such a process including steps for reducing formation of coke in pyrolysis furnaces and associated equipment such as transfer line exchangers.

Olefins such as ethylene and propylene are produced by pyrolysis (thermal cracking) of petroleum gases (butane, ethane, propane, etc.) or of distillates such as naphtha, n-hexane and gas oil. The cracking reactions occur in a thermal reactor comprising tubes or coils inside a high-temperature furnace. During manufacture of olefins, steam can be added to the hydrocarbon feedstocks to reduce hydrocarbon partial pressure to promote production of olefins and to minimize rate of coke deposition. The cracking reactions occur under a reducing atmosphere in which there is substantially no oxygen present.

Pyrolysis tubes are made of metal alloys which can withstand the high temperature and stress-strain relationship of production conditions and that are stable against carburization. A special 25% chrome-20% nickel alloy has been a preferred tube material for reactor coils. Materials having a still higher nickel content, which may be alloyed with minor amounts of carbide stabilizers such as tungsten and niobium (columbium), also are used. Such materials contain catalytic sites which promote the formation of catalytic coke. Typically, other portions of the cracker are made of lower grade steels which are less corrosion-resistant.

Illustrative of olefins production, cracking of petroleum gases or distillates to produce ethylene is accomplished by passing the hydrocarbon feedstock at a positive pressure into a high-temperature cracking furnace composed of a feed section, a convection heating coil section and radiant coil cracking section; cracking the feed in the cracking furnace at a temperature in the range of from about 650° C. to about 930° C. and in the presence of steam, with the steam-to-hydrocarbon ratio typically in the range of from about 0.2:1 to about 1.5:1; pressurizing the cracking furnace effluent in a compressor from substantially atmospheric pressure; and fractionating the pressurized cracking furnace effluent, wherein the pressure profile within the cracking furnace is optimized to maximize the yield of ethylene. Modern ethylene plants are normally designed for near-maximum cracking severity, a term used to describe the depth of cracking or extent of conversion, because of economic considerations. Hence, the production of ethylene from hydrocarbon feedstocks is accompanied by the production of other olefins which entails co-production of many industrially important petrochemicals.

The effluent from the pyrolysis furnace is provided to a transfer-line exchanger (TLE) located adjacent to the furnace. The TLE provides rapid cooling of the heater effluent to prevent further reactions of the effluent from continuing thereby impairing the yield of primary products.

The gaseous effluent from the pyrolysis furnace leaves the TLE at temperatures in the range of 300° C. to 600° C. to enter the separation and recovery portion of the ethylene plant. In this portion, effluent is separated into the desired products by compression in conjunction with condensation and fractionation at gradually lower temperatures. Typically, all the $C_2$'s are separated from $C_3$'s and higher. Acetylene must be removed from the $C_2$ fraction to meet ethylene specifications. Most frequently, the acetylene is eliminated by hydrogenation of the $C_2$ fraction in the presence of an effective acetylene conversion catalyst.

During operation of olefin furnaces, there is a buildup of coke on the inside of the furnace tubes or coils into which the hydrocarbon feedstocks are fed and on the inside of the tubes or coils in the transfer line heat exchangers into which the effluent from the furnaces is fed. This coke buildup in the ethylene cracking furnace, and in the associated transfer line heat exchanger tubes or coils, reduces heat transfer occurring in the tubes or coils, causes brittlization of the tubes or coils, and reduces the flow rate through the tubes or coils. The coke is removed periodically by steam-air decoking, which, in addition to requiring labor and steam generation facilities and the use of fuel to generate the steam, requires stopping olefins cracking, resulting in olefins production losses due to downtime and other maintenance and utility costs.

To alleviate or minimize the coking rate and to enhance the ethylene production-run length, trace amounts of sulfur compounds such as hydrogen sulfide or ethyl mercaptan (if the feedstock is basically free of sulfur compounds) or antifoulants have been added to the hydrocarbon feedstocks.

Numerous phosphorous-containing compounds have been proposed for continuous or intermittent addition to hydrocarbon or steam feeds to ethylene cracking furnaces. See, for example, Kozman U.S. Pat. No. 3,531,394; Kozman Canadian Patent 935,190; Japanese Patent Application No. 5887/1985; British Patent 985,180; Weinland V. 4,105,540; Kaplan U.S. Pat. No. 4,542,253 etc. Most of these patents suggest pretreatment of the reactor before continuous or intermittent addition to the feed stream. However, these patents do not disclose or suggest using feedstocks free of the phosphorous-containing compound after preconditioning the reactor with phosphorous antifoulants.

These phosphorous compounds are effective coking antifoulants but produce phosphine under ethylene cracking conditions which can deactivate downstream acetylene conversion catalysts.

Phosphorous-containing compounds also cause corrosion problems which some have proposed to alleviate by neutralizing or adding amine stabilizers. To the best of our knowledge, no satisfactory solution to this problem has been found and, in fact, to the best of our knowledge, no phosphorous-containing antifoulants are being used now.

An improved olefin production process is needed which can diminish formation of catalytic coke in furnaces and associated downstream processing equipment. Some of the benefits are longer furnace run length; enhanced flexibility or control of conversion, selectivity and yield; reduced decoking costs; reduced maintenance and tube replacement costs; and significantly improved control of production capability and operating economics.

An improved olefin production process is needed which can diminish formation of catalytic coke while eliminating or limiting the risk of phosphine contamination of downstream hydrogenation catalysts such as acetylene conversion catalyst.

An improved olefin production process is needed which diminishes the amount of coking antifoulant required.

An improved olefin production process is needed which can diminish formation of catalytic coke and can be used with existing olefin plants without significant capital expenditure.

The general object of this invention is to provide an improved olefin production process which can diminish formation of catalytic coke without requiring major modifications to equipment and without significantly departing from olefin plant operating procedures. Other objects appear hereinafter.

SUMMARY OF THE INVENTION

A process for the production of olefins in an olefin plant, which includes an olefin pyrolysis furnace having pyrolysis tubes in which hydrocarbon feedstock is cracked, comprises introducing hydrocarbon feed substantially free of phosphorous-containing compounds into the pyrolysis furnace and operating the furnace under pyrolysis conditions producing olefin-containing effluent therefrom wherein the pyrolysis tubes have an effective passivator of metal catalytic sites bonded to the exposed metal surface by injecting an effective passivator into the furnace at a point above the dew point of water.

BRIEF DESCRIPTION OF THE INVENTION

Figure 1:
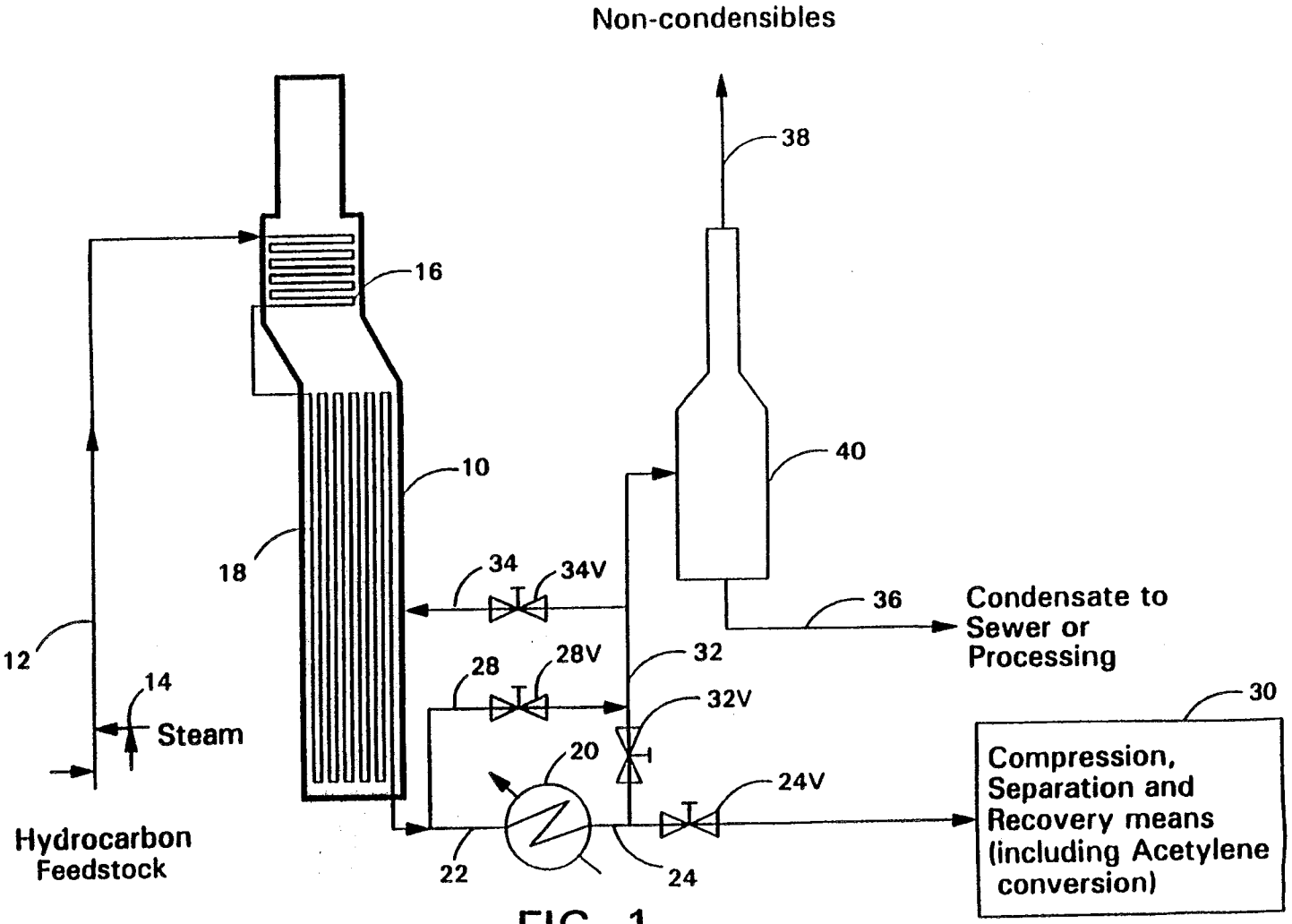
FIG. 1 illustrates schematically an olefins production plant.

One aspect of this invention is a process for the production of olefins in an olefin plant comprising an olefin pyrolysis furnace having a hydrocarbon feed port, a convection heating section composed of several heating coils and cracking section composed of pyrolysis tubes in which hydrocarbon feedstock is cracked, forming olefins, the process comprising injecting an effective antifoulant in an effective concentration into the furnace at a point where the furnace temperature is above the dew point of water downstream of said hydrocarbon feed port.

In a second aspect our invention is a process for the production of olefins in an olefin plant comprising an olefin pyrolysis furnace having pyrolysis tubes in which hydrocarbon feedstock is cracked forming olefins, process comprising: (a) introducing hydrocarbon feed substantially free of phosphorous-containing compounds into the pyrolysis furnace and operating the furnace under pyrolysis conditions producing olefin-containing effluent therefrom; (b) discontinuing step (a) and removing coke from surfaces of the tubes in the pyrolysis furnace and (i) continuing the removal of coke until the metal surface of the tubes is substantially exposed and free of coke deposits and then (ii) contacting the exposed metal surface of the tubes with an effective passivator of metal catalytic sites on the exposed metal surface and passivating the metal catalytic sites; and (c) repeating steps (a) and (b);

In another aspect the invention includes adding effective passivator of metal catalytic sites in an effective concentration into the furnace at a point wherein the furnace temperature is above the dew point of water downstream of the hydrocarbon feed addition.

A fourth aspect of this invention is a process for the production of olefins in an olefins plant comprising an olefins pyrolysis furnace having a hydrocarbon feed port, a convection heating section comprising several heating coils and cracking section composed of pyrolysis tubes in which hydrocarbon feed is cracked, forming olefins, the process comprising:

(a) introducing hydrocarbon feed substantially free of phosphorous-containing compounds into the pyrolysis furnace and operating the furnace under pyrolysis conditions producing olefin containing effluent therefrom; and (b) discontinuing step (a) and removing coke from the surface of the tubes in the pyrolysis furnace and (i) continuing the removal of coke until the metal surface of the tubes is substantially exposed and free of coke deposits and then (ii) contacting the exposed metal surface of the tubes with an effective concentration of an effective phosphorous-containing passivator of metal catalytic sites on the exposed metal surface by injecting the effective phosphorous-containing passivator into the furnace at a point where the furnace temperature is above the dew point of water and downstream of said hydrocarbon feed port.

In a fifth aspect, this invention is a process for the production of olefins in an olefin plant comprising an olefin pyrolysis furnace having pyrolysis tubes in which hydrocarbon feedstock is cracked, the process comprising introducing hydrocarbon feed substantially free of phosphorous-containing compounds into pyrolysis furnace and operating the furnace under pyrolysis conditions producing olefin containing effluent therefrom, wherein the pyrolysis tubes have an effective passivator of metal catalytic sites bonded to the exposed metal surface.

FIG. 1 illustrates the operation of an olefins plant.

Ethylene furnace 10, transfer line exchanger 20, compression, separation and recovery means (including acetylene conversion) 30, and decoke drum 40 are typical units of olefins plants and need not be described here in detail since design and operation of such plants generally is well-known to those skilled in the art. See, for example, Kirk-Othmer, Encyclopedia of Chemical Technology, Volume 9, pages 400 to 411 (Third Edition, 1980).

In the olefins production mode of operation, a hydrocarbon stream 12 admixed with steam 14 is introduced into preheating coils 16 and then into cracking coils 18 of furnace 10. Effluent from cracking coils 18 containing ethylene, other olefins, by-products, and unreacted feed compounds is removed from furnace 10 by line 22 and provided to transfer line exchanger 20. Cooled effluent from the transfer line exchanger 20 is provided by line 24 and valve 24V to compression, separation, and recovery means 30, which, as illustrated, can include acetylene conversion means, including an effective hydrogenation catalyst for converting acetylene present in the effluent to ethane and/or ethylene. Operation of the plant in the olefins production mode need not be further described because it is well known to those skilled in the art.

During the decoking mode, which can be conducted either on-line or off-line, as known to those skilled in the art, hydrocarbon introduction is discontinued, and coke is removed from the interior surface of the coils oxidatively, mechanically, chemically or by combination of two or more processes. Decoking of TLE 20 can proceed concurrently if desired.

During decoking, valve 24V is closed and effluent containing coke is removed via valved line 28 or via line 32 having valve 32V open to decoke drum 40. Non-condensables are removed overhead by line 38 and condensables are removed via line 36 to further processing. Alternatively, the coke-containing effluent may be returned via line 34 and valve 34V to the furnace firebox 10, for combustion of undesirable decoking by-products. Decoking of pyrolysis furnaces and TLE's is well-known to those skilled in the art and need not be further described here.

We have now found that there are numerous chemical compounds capable of passivating catalytically active metal surfaces under high temperature conditions and reducing the rate of formation of catalytic coke without adding passivating agent to the feedstock. Further, by carrying out the passivation under suitable conditions, it is possible to avoid or substantially reduce reactor corrosion and prevent phosphine attack on downstream acetylene hydrogenation catalysts. The present invention is based upon several discoveries. For example, tubes in olefin pyrolysis furnaces or transfer line exchangers can be catalytically passivated by applying suitable passivators at effective treatment rates for a short period of time relative to the operating cycle of the olefin plant. (If desired, pyrolysis furnace tubes can be treated before being installed in the furnace.) The process results in catalytically inactive metallurgy which does not foul with coke as rapidly as metallurgy which has not been treated in accordance with the invention. Results indicate that a furnace can even go through several olefin production/decoking cycles before additional treatment is required. There is no need to add passivating agent to the hydrocarbon feed.

If the passivating agent is added downstream of the hydrocarbon feed inlet port at a point where the furnace temperature is above the dew point of water, preferably downstream of the first convection heating coils, the passivating agent cannot be hydrolyzed into an acidic material and corrosion is essentially prevented. It is now possible to use any effective antifoulant, such as a phosphorous-containing antifoulant, without corrosion of the hydrocarbon feed lines 12 of FIG. 1 from the feed port through the convection heating section. Accordingly, during substantially all of a period of operation in an olefin production mode, a hydrocarbon feedstock substantially free of phosphorous-containing compounds can be introduced into a pyrolysis furnace and an olefin-containing effluent is produced. The effluent can be passed through a transfer line exchanger (TLE) and olefin separation and recovery means for separating and recovering ethylene and by-products. During a tube-treating mode in which olefins are not being produced, or which is carried out only minimally concurrently with the olefin production mode, a stream comprising effective amounts of an effective phosphorous-containing metal-passivating antifoulant can be introduced into tubes of the pyrolysis furnace.

Accordingly, one inventive concept described herein comprises the production of olefins in an olefin plant comprising an olefin pyrolysis furnace having pyrolysis tubes in which hydrocarbon feedstock is cracked, forming olefins, which process comprises, during an olefin production mode of operation, introducing hydrocarbon feed substantially free of phosphorous-containing compounds into the pyrolysis furnace and operating the furnace under pyrolysis conditions producing olefin-containing effluent therefrom; at intervals, production of olefins is discontinued, and during a decoking mode of operation, coke is removed from surfaces of the tubes in the pyrolysis furnace, and optionally from tubes in the TLE; during the decoking mode of operations, the removal of coke is continued until the metal surface of the tubes is substantially exposed and free of coke and other deposits and surface-corrosion; then substantially all of the exposed metal surface of the tubes is contacted with an effective passivator of metal catalytic sites on the exposed metal surface for a period of time effective for passivating the metal catalytic sites, addition of passivator is discontinued and reintroduction of hydrocarbon feed substantially free of antifoulant or passivator is carried out.

Figure 2:
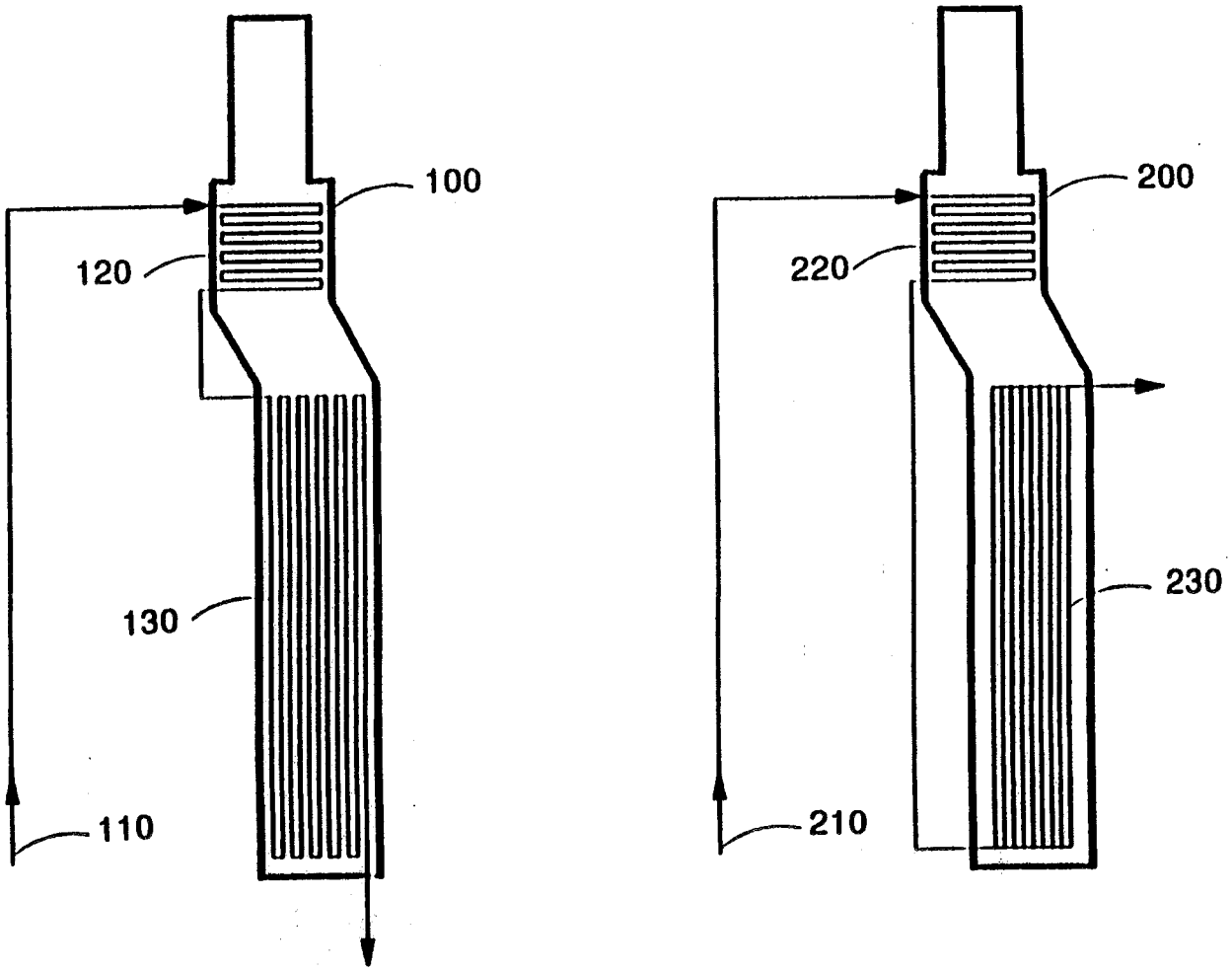
FIG. 2 illustrates schematically treating olefins furnaces.

A second inventive concept comprises adding the passivator to olefin furnace at a point where the furnace temperature is above the dew point of water and downstream of the hydrocarbon feed port. FIG. 2, which is a schematic drawing of two commercial high temperature cracking furnaces, illustrates that passivating compounds can be introduced into furnace tubes at various locations above the dew point of water, generally at above about 370° C. and at a pressure of about 1 to 15 kg/sq.cm. Furnaces 100 and 200 have hydrocarbon feed ports 110 and 210 respectively, convection coils 120 and 220 and pyrolysis coils 130 and 230. Passivators can be added at points 120 and 220 provided the furnace is above the dew point of water at 120 and 220, and at 130 and 230 or at multiple locations. When passivators are added to the convection coils, the inlet point is usually past the mid-point of the convection coils, preferably at the last pass in order to have the process unit at a temperature above the dew point of water. Preferably, the passivator is added downstream of the convection coils in order to be certain that the process unit temperature is above the dew point of water.

According to the invention, during olefin production mode, an olefin furnace is operated for the production of olefins, including ethylene, by introducing an effective hydrocarbon feedstock into the furnace and operating the furnace for the production of olefins. As indicated above, the construction and operation of olefin plants is well-known to those skilled in the art and need not be described in detail.

During the olefin production mode, the feedstock to the furnace is preferably substantially free of antifoulant, particularly phosphorous-containing compounds, and the effluent from the furnace containing olefins is passed to downstream equipment for cooling and product separation and recovery.

During production of the olefin, furnace accumulation of coke on internal surfaces of furnace tubes can be monitored by methods known to those skilled in the art, including monitoring pressure drop across the furnace, and/or monitoring tube metal temperatures.

As is known, once an indicator of coking exceeds a predetermined limit, the furnace can be removed from olefin production mode for decoking. During the decoking mode of operation of the furnace, furnace tubes can be mechanically, chemically, or oxidatively cleaned of accumulated coke. For example, steam admixed with oxygen can be used to burn coke from the internal surfaces of the tubes. Preferably, this step is continued until substantially all of the metal surface of the inner walls of the tubes are exposed. This is particularly important when passivator treatment follows decoking.

Following decoking, an effective passivator is caused to contact the exposed metal surfaces of the tubes. Suitable passivators include tetrahydrothiophene, magnesium salt of N, N'-bis (dodecylhydroxybenzyl) ethylenediamine, magnesium salt of 2-amino-phenol salicylaldehyde, phosphorous-containing compounds, and the like. Phosphorous-containing compounds generally are preferred since the preferred phosphorous compounds react with the metal surface of tubes and need not be applied as frequently after decoking cycles. Of the others, tetrahydrothiophene is a very good passivator and has the advantage that it can be added to the hydrocarbon feed without danger of forming phosphine downstream or other corrosive decomposition products.

The phosphorous-containing compound can be any of the known phosphorous-containing coking inhibitors. Those phosphorous compounds are preferred because they possess a greater affinity for the metal surface of the tubes, particularly those compounds containing oxyether and thioether compounds described below.

The phosphorous-containing antifoulant can include:

(1) organic phosphates (phosphoric acid esters) of the formula $(RO)_3PO$ where each R may be H or a $C_1$–$C_{30}$ alkyl, alkenyl, alkynyl, aryl, alkaryl, cycloalkyl, or alkaryl radical. Examples include trimethyl phosphate, triethyl phosphate, triphenyl propyl phosphate, dimethyl propyl phosphate, cyclohexyl methyl phosphate, and the like.

(2) Thiophosphoric acid esters of the formula $(RX)_3PX$ where each X can be O or S, and at least one X is S, and each R can be as described above. Examples include mono-, di-, and triesters of mono-, di-, tri-, and tetrathiophosphoric acid. Diesters of dithiophosphoric acid are preferred.

Diesters of dithiophosphoric acid can be produced by the reaction of a phosphorous pentasulfide with alcohols or phenols in a well-known process such as the process described in U.S. Pat. No. 4,496,495. This process can be described in general terms by the following equation, where R, R', and R'' represent $C_1$–$C_{30}$ aliphatic, alicyclic, or aromatic hydrocarbon groups or a mixture thereof:

$$P_2S_5 + 4ROH \longrightarrow 2R'O-\overset{\overset{S}{\|}}{\underset{\underset{OR''}{|}}{P}}-SH + H_2S$$

In particular, 2-ethylhexanol, isooctyl alcohol, neopentyl alcohol, phenol, nonylphenol, amylphenol, butylphenol and benzyl alcohol, can be reacted with phosphorus pentasulfide to form metal passivators useful in this invention. Other monohydric alcohols containing at least 5 carbon atoms can be used to produce diesters of dithiophosphoric acid that will function as metal passivators in ethylene furnaces.

It is thought that alcohols containing at least five carbon atoms are suitable in that the resulting diesters of dithiophosphoric acid will have sufficient size to occupy the catalytic sites where coke formation by the metal catalyzation process would otherwise occur. It is further thought that alcohols containing between about five and about 15 or more carbon atoms are suitable in that the resulting diesters of dithiophosphoric acid will have sufficient size to occupy the catalytic sites where coke formation by the metal catalytic process would otherwise occur and at the same time will be easily handled as a liquid.

It is thought that the reaction of phosphorus pentasulfide with monohydric alcohols, with substitution of aliphatic, alicyclic, or aromatic hydrocarbon groups or a mixture thereof for Beta hydrogens, insures better thermal stability of the resulting metal passivator. The term "Beta hydrogen" refers to the hydrogen atoms attached to the Beta or second carbon atom, counting from the carbon atom having the hydroxyl group attached thereto. A preferred diester of dithiophosphoric acid with substitution of hydrocarbon groups for Beta hydrogens is produced by reacting 2-ethylhexyl alcohol with phosphorus pentasulfide.

(3) Elemental phosphorous.

(4) Phosphoric acids such as metaphosphoric acid, pyrophosphoric acid, orthophosphoric acid and phosphorous acids. These acids are generally water, not hydrocarbon soluble.

(5) Phosphine ($PH_3$) and phosphine derivatives of the formula $R_3P$ where each R may be selected as described above. Examples include methyl phosphine, ethyl phosphine, phenyl phosphine, dimethyl phosphine, trimethyl phosphine, tributyl phosphine, and the like.

Phosphine oxides of the formula $R_3PO$ such as triphenyl phosphine oxide.

Phosphine sulfides of the formula $R_3PS$ such as triphenyl phosphine sulfide.

(6) Phosphorous sulfides such as phosphorous pentasulfide ($P_2S_5$).

(7) Quaternary phosphines of the formula $R_4P^+Z^-$ where each R can be as described above where Z— is OH—, Cl—, Br—, $CH_3CO_2$—, and the like.

(8) Organic phosphites of the formula $P(OR)_3$ in which R can be as described above.

(9) Organic thiophosphites of the formula $P(XR)_3$ where each X can be O or S and where R can be as described above.

The step of contacting the exposed metal surfaces of the cracking tubes of the pyrolysis furnace with the effective passivator, particularly the effective phosphorous-containing passivator, can be carried out in various ways. The contacting step is preferably carded out under conditions which either limit the period of time that phosphines are produced by phosphorous passivators at high temperatures or preclude phosphines from being passed downstream to acetylene conversion. The contacting step is likewise preferably carried out under conditions which limit the period of time when phosphorous compounds are in contact with the furnace tubes.

According to one aspect of the invention, following decoking, and prior to startup of the furnace for operation in the olefin production mode, the antifoulant can be introduced into a stream of steam and passed through the furnace coils for a period of time effective to substantially passivate catalytic surfaces on the coils. Generally, a period of 6 to 36 hours has been found satisfactory. As used herein, "substantially passivating" indicates that further treatment has no significant effect on reducing coking. The amount of passivator depends on the surface area of the internal surface of the tubes and on the diluent or carrier used to carry the passivator into contact with the tubes, on the flow rate of the passivator, on the tube geometry and the like.

Preferably, the passivator is introduced by determining the exposed surface area of the tubes to be treated and then introducing the passivator over the treatment period in an amount determined by the exposed surface areas and independent of the parts per million rating of passivator in the hydrocarbon feed. Stated in another way, if the introduction of passivator is based on concentration in a stream passing through the furnace tubes, introduction may be discontinued upon reaching a total amount of introduction which is predetermined for each furnace based on exposed internal tube surface area.

Following discontinuing introduction of passivator, the furnace can be started up normally. By the time hydrocarbon feedstock is introduced and the furnace is lined out for normal olefin production mode of operation, any residual passivator will have exited the furnace and the risk of downstream phosphine contamination will be substantially eliminated.

According to another aspect, the passivator can be introduced into the cracking tubes of the furnace by filling the tubes with the passivator either external to the furnace or in the furnace, allowing the passivator to remain in contact for a period of time, and then removing the passivator from the tubes prior to entering into the normal start up procedure for the furnace. Preferably, the passivator is introduced neat; however, a carrier can also be used. This process can be conducted at ambient temperatures or with light burners, typically, at temperatures below about 205° C.

The period of time required for substantially passivating the catalytic surfaces can be readily determined by those skilled in the art.

The amount of passivator to be introduced is, in accordance with an aspect of the invention, determined based on the exposed surface area of the tubes.

The step of contacting the exposed metal surface resulting from decoking procedures must be carded out according to the invention, while the metal surfaces are still exposed and prior to formation of thermal or catalytic coke which inhibits passivation of the active sites.

During normal decoking, steam and air are used to burn out accumulated coke and tube temperatures are as hot as or hotter than temperatures during olefin production. As decoking is completed, hydrocarbon feed is introduced (mixed with dilution steam) for olefin production. Then the feed and furnace are gradually brought to olefin production temperatures. Typically, the process of bringing to cracking temperatures may require 2–16 hours. It is sometimes thought to be desirable to bring the furnace to a level effective for permitting thermal coke production, for example, around 980° C., for 24 hours, permitting thermal coke to cover catalytic sites before continuing bringing the furnace to normal cracking temperatures.

Typically, production of phosphine requires temperatures of at least 650° C. and presence of phosphorous compounds such as phosphorous-containing passivators described herein.

The tube-treating period, in accordance with the invention, represents only a fraction of the total cycle time required for olefin production, decoking, and tube treating.

According to the invention, the furnace tube catalytic site passivating chemical can be applied to metal surfaces by feeding it at prespecified feed rates (maybe 30 to 3000 ppm) for a pre-specified period of time (maybe 4 hours to 3 days). The preconditioning step can, for example, occur at the end of a decoking operation or during startup.

According to an aspect of the invention, the tube-treating mode of operation can be effected between periods of operating in the ethylene production mode. Thus, for example, valve 24 can be closed and furnace effluent diverted via line 32 to drum 40 for removal and valve 28V opened if TLE tubes are not to be treated. During this period, hydrocarbon feed is discontinued while the antifoulant is being introduced. The antifoulant can be introduced in either the steam feed, or in its own carder solvent as desired.

Where the tube-treating chemical comprises a phosphorous-containing compound which can react to produce phosphine or other acetylene catalyst deactivators under pyrolysis conditions, effluent from furnace 10 or TLE 20 can be diverted away from means 30 for a period after discontinuing introduction of the treating chemicals to prevent phosphine and corrosive chemicals from being provided to means 30.

According to a further aspect of the invention, the tube-treating mode of operation can be effected following a decoking mode period of operation. This permits the catalyst site passivating chemicals to contact newly-cleaned surfaces of the tubes of furnace 10 or TLE 20.

Preferably, the catalyst passivating compounds are introduced in a way that assures uniform distribution onto the internals of the pyrolysis or TLE tubes. Atomization of the liquid additive is preferred.

The furnace antifoulant should be fed for sufficient duration and at sufficient concentration to coat the internals of tubes in the radiant section for a minimum of time.

Depending on furnace design and the variation in operating procedures during decoking mode, the tube-treating mode can vary. Generally, the tube-treating mode occurs immediately after the decoking burn is complete, i.e., after substantially all coke has been removed and the metal surfaces are substantially exposed.

During decoking, the progress of decoking can be monitored by detecting presence of carbon monoxide (CO) or carbon dioxide ($CO_2$)in effluent from the furnace or TLE being decoked. As is known, so long as coke is being burned, the CO and $CO_2$ levels in the effluent remain at a level determined by the burn condition, such as $O_2$ inlet rate, and the like. As the decoking burn is completed, the CO and $CO_2$levels fall to a new, lower level. This transition indicates that the metal tubes are substantially free of coke and metal surfaces are exposed.

Those skilled in the art will appreciate that the procedures referred to in on-line and off-line decoking are not necessarily equivalent in extent of coke removal. In accordance with the invention, however, whenever the tube-treating mode of operation is indicated, the decoking process should be continued until the CO, $CO_2$ transition occurs, indicating substantially complete removal of coke and exposure of metal surfaces.

The tube-treating mode can be conducted immediately after the decoking burn is complete:

(1) at ambient temperature while the furnace is not in operation;

(2) in the presence of steam before hydrocarbon feed is introduced; or (3) in the presence of steam and hydrocarbon during startup and/or during an initial portion of olefin production mode of operation.

If desired, the tubes can be passivated by the supplier of tubes or prior to installation into the furnace. In any case, the treated pyrolysis tubes have an effective passivator of metal catalytic sites bonded to the exposed metal surface, usually a chrome nickel steel.

An advantage of the invention described is that conventional presulfiding of a furnace, by incorporating sulfur-containing compounds such as dimethyl sulfide or hydrogen sulfide in the hydrocarbon feedstream at start-up, can be reduced or eliminated.

Our invention is illustrated, but not limited by the following Examples.

EXAMPLES

Example 1

A series of untreated coke/decoke cycles were run using a virgin Inconel alloy 600 tube. A minimum of 10 cycles were run, untreated, to establish a baseline coking rate. The coking rate was determined by weighing the tube after the coke cycle and subtracting the weight of the tube after the decoke cycle. After the baseline coking rate was established, the furnace tube was treated by filling it with a 1000 ppm solution (in an aliphatic or aqueous solvent) of the coke inhibitor. The filled tube was allowed to stand for approximately 5 minutes and then drained for approximately 2–3 minutes. The treatment was applied after each decoke cycle. After treatment, a coke cycle was then run. This was repeated for a minimum of 5 coke/decoke cycles. A reduction in the coking rate indicates that the coke inhibitor was effective. To determine whether the coke inhibitor had a memory effect, treatment of the furnace tube was stopped and at least 3–4 coke/decoke cycles were repeated. If the coking rate were still lower than the baseline coking rate, the coke inhibitor would have had a memory effect.

A coke cycle consisted of installing the tube in the furnace and purging the system with nitrogen, at the appropriate flow rate, for at least 3 minutes to remove any oxygen that was present. The furnace was turned on and heated to 800° C. over an 18-minute period. Butane was then added at the appropriate flow rate. After 18 minutes, the butane flow was stopped and the furnace cooled. The tube was removed from the furnace, cooled to room temperature, and then weighed on a 2-place balance. The tube was now ready for the decoke cycle.

A decoke cycle consisted of installing the tube in the furnace and purging the system with nitrogen for at least 3 minutes. The furnace was then heated to 800° C. over an 18-minute period. Air, at the appropriate flow rate, was then added and the nitrogen flow was shut off. Air was then flowed through the furnace tube for a minimum of 18 minutes to ensure a complete burn out of the coke. The air flow was then shut off and the furnace cooled. The decoked tube was cooled to room temperature and weighed on a 2-place balance. Any loose tube scale that formed was removed by inverting the tube and gently tapping the end of the tube. The tube was now ready for the coke cycle or for treatment with a coke inhibitor.

Thirty percent tetrahydrothiophene in xylene was evaluated as a coke inhibitor and the memory effect demonstrated by running a series of 28 untreated coke/decoke cycles on a virgin Inconel 600 tube. The baseline coking rate was determined by averaging the coking rates between the 16th cycle and the 28th cycle. The untreated coking rate was found to be 0.45 g/18 min. After the last decoke cycle, the tube was then treated by filling the tube with 1000 ppm of 30% tetrahydrothiophene in xylene. The tube was left to stand for 5 minutes. The tube was then drained for 2–3 minutes. A coke cycle was then run and the coke rate measured. The tube was then decoked. This procedure was repeated for a total of 14 cycles. The treated coke rate was found to be 0.21 g/18 min, which was a 53% reduction in coke formation. A series of 8 blank coke/decoke cycles were immediately run on the same tube. The coke rate remained stable at 0.17 g/18 min.

Example 2

Phosphoric acid was evaluated as a coke inhibitor and the memory effect demonstrated by running a series of 12 untreated coke/decoke cycles on a virgin Inconel 600 tube. The baseline coking rate was determined by averaging the coking rates between the 5th and the 12th cycles. The untreated coking rate was found to be 0.70 g/18 min. After the last decoke cycle, the tube was then treated by filling the tube with 1000 ppm phosphoric acid in water. The tube was left to stand for 5 minutes, then drained for 2–3 minutes. A coke cycle was then run and the coke rate measured. The tube was then decoked. This procedure was repeated for a total of 7 coke/decoke cycles. The treated coke rate was 0.48 g/18 min, which was a 31% reduction in coke formation. A series of 7 blank coke/decoke cycles was immediately run on the same tube. The coke rate remained stable at 0.31 g/18 min.

Example 3

This example illustrates the use of 100% active bis (2-ethylhexyl) dithiophosphoric acid in a unit of the type shown in FIGS. 1 and 2. The unit was retrofitted with eight high temperature atomizing nozzles downstream of the convection coils in the inlet pass of each radiant coil. Over a 24-hour period, 1041 liters (2700 ppmm) of bis (2-ethylhexyl) dithiophosphoric acid, were fed, split equally, to each of the eight coils. The furnace was lined up to the upper decoke header and both the furnace and transfer line exchangers were treated. Three hundred twenty-five square meters of metal were treated with 1016 kilograms of bis(2-ethylhexyl) dithiophosphoric acid for 22 hours at about 870° C. using nitrogen atomizing gas at 6.3 kg/sq.cm pressure and a targeted flow rate of 2.4 liters/minute per nozzle. It had been anticipated that within a few hours after discontinuing treatment any residual chemical would have exited the furnace. However, phosphorous continued to "leach" from the furnace for approximately one week. Two days after treatment was stopped, the furnace was taken off-line and decoked in an effort to remove residual chemical, This seemed to lower phosphorous levels substantially but leaching continued for several more days. About 20 days after treatment, one TLE had an unrelated tube failure and the furnace came down for decoke and TLE repair. Apparently, bis (2-ethylhexyl) dithiophosphoric acid had deposited in the colder areas of the TLE (315° C.) and was the source of the phosphate leaching. Over the next three months, there were three more decokes, two due to unit repairs not connected to the use of bis (2-ethylhexyl) dithiophosphoric acid and the last decoke was in preparation for a new treatment with bis (2-ethylhexyl) dithiophosphoric acid.

In spite of the numerous short runs after the bis (2-ethylhexyl) dithiophosphoric acid treatments, the test treatment was considered successful since comparison of $CO_2$levels on decoking of different untreated furnaces in the same time period had $CO_2$concentration at the start of the burn typically in the 10 to 15% range regardless of run length (7 to 60 days), whereas the treated furnace after 46 days propane feed was at 2% (i.e., very little coke available for combustion).

Example 4

The decoked furnace of Example 3 was treated with 416 liters of bis (2-ethylhexyl) dithiophosphoric acid, in the manner described in Example 3, for 21 hours with the furnace lined up through the lower decoke header to the decoke drum, and the TLE's outlet valves were closed to avoid phosphate leaching experienced in Example 3. Within 2½ hours after stopping treatment, phosphate levels in the effluent were normal. The furnace was on stream for 32 days without any upset.

That which is claimed is:

1. A process for production of olefins in an olefins plant comprising an olefins pyrolysis furnace having a hydrocarbon feed port, a convection heating section comprising a plurality of heating coils and cracking sections comprising pyrolysis tubes in which hydrocarbon feed is cracked under pyrolysis conditions to form olefins, which process comprises:

(a) introducing hydrocarbon feed substantially free of phosphorous-containing compounds into the pyrolysis furnace and operating the furnace under pyrolysis conditions to produce an olefin-containing effluent therefrom; and (b) discontinuing step (a) and removing coke from surfaces of the pyrolysis tubes and (i) continuing the removal of coke until the metal surface of the tubes is substantially exposed and free of coke deposits and then (ii) contacting the exposed metal surface of the tubes with an effective phosphorous-containing passivator of metal catalytic sites on the exposed metal surface by injecting the effective phosphorous-containing passivator into the furnace at a point above the dew point of water and downstream of said hydrocarbon feed port.

2. The process of claim 1 comprising repeating steps (a) and (b)(i) at least two times prior to conducting step (b)(ii).

3. The process of claim 1, wherein the phosphorous-containing passivator contains pentavalent phosphorous.

4. The process of claim 3, wherein the phosphorous-containing passivator is a dithiophosphoric acid ester.

5. The process of claim 4, wherein the phosphorous-containing passivator is bis (2-ethylhexyl) dithiophosphoric acid.

6. The process of claim 1, wherein the phosphorous-containing passivator is added to the convection coils.

7. The process of claim 1, wherein the phosphorous-containing passivator is added downstream of the convection coils.

* * * * *